US006783034B1

(12) United States Patent
Brent

(10) Patent No.: US 6,783,034 B1
(45) Date of Patent: Aug. 31, 2004

(54) LIQUID CARRIER ARTICLE

(76) Inventor: Timothy Brent, 3900 N. Pine Grove, #1001, Chicago, IL (US) 60657

( * ) Notice: Subject to any disclaimer, the term of this patent is extended or adjusted under 35 U.S.C. 154(b) by 0 days.

(21) Appl. No.: 10/694,961

(22) Filed: Oct. 28, 2003

Related U.S. Application Data

(60) Provisional application No. 60/421,767, filed on Oct. 29, 2002.

(51) Int. Cl.[7] ..... B67D 5/06
(52) U.S. Cl. ..... 222/183; 222/325
(58) Field of Search ..... 222/131, 183, 222/399, 146.6, 325

(56) References Cited

U.S. PATENT DOCUMENTS 2,792,692 A * 5/1957 Reed ..... 222/146.6
5,199,609 A * 4/1993 Ash, Jr. ..... 222/325
5,282,561 A * 2/1994 Mihalich ..... 222/399

* cited by examiner

*Primary Examiner*—Philippe Derakshani
(74) *Attorney, Agent, or Firm*—Chapman and Cutler LLP

(57) ABSTRACT

A carrier of liquid is manually portable, thermally insulated, and pressurizable for dispensing the liquid, particularly cold or hot potable beverages such as beer, water, lemonade, sports drinks, tea, and the like. A container for holding the liquid can be pressurized by hand or other pump or by a gas cartridge, and the liquid flows when desired from the container through a tube and a dispensing valve mounted in the carrier wall. The carrier is thermally insulated to retain cold or heat in the liquid, and ice or hot briquettes can be placed about the container within the carrier walls to retain the desired temperature for a longer period. Handles and wheels can be mounted to the carrier to make the article more easily portable.

5 Claims, 3 Drawing Sheets

LIQUID CARRIER ARTICLE

RELATED PRIOR APPLICATION

The priority of prior, now abandoned, provisional U.S. application Ser. No. 60/421,767, filed Oct. 29, 2002, is claimed.

FIELD OF THE INVENTION

The present invention relates to carriers for kegs and other containers for beverages, whether lemonade, beer, hot or cold tea, and other liquids, which are thermally insulated, portable, and refillable, and which self-dispense through pressure instilled into the container.

BACKGROUND OF THE ART

Various means of dispensing liquid beverages on location are known, for picnics, backyard parties, tailgate parties, and even at home for larger gatherings. Beer kegs are typically large and unwieldy, containing 13 to 15 gallons, but are a favorite beverage dispenser for both commercial and home brew beers. However such kegs must be separately carried and cooled, and their dispensing mechanism is uncertain in many situations. A variety of portable beverage dispensing articles are known in the patent literature, as Nelson U.S. Pat. No. 4,350,267, Kappos U.S. Pat. No. 4,225,059, Ash U.S. Pat. No. 5,199,609, and Mihalich U.S. Pat. No. 5,282,561, and others. No such device as disclosed in these patents is known to be commercially successful or available for convenient, flexible use by individuals.

SUMMARY OF THE INVENTION

It is an object of this invention to provide a conveniently portable liquid carrier for making bulk liquids such as cold or hot beverages available to users for dispensing on location.

The carrier in one embodiment is an insulated vessel such as an Igloo®-brand cooler, which is fitted through the sidewall with a dispensing valve outlet and a pressurizing valve inlet. A container with a 2.5-, 3, or 5-gallon capacity is suitable for carriers of different sizes for use in this invention; these containers are available as beer kegs with tap and pressurizing connectors as well as a sealable opening on top for loading the liquid quickly and for access for cleaning between uses. A hand or foot pump, an electric pump, or preferably a gas cartridge can be used to pressurize the container. Ice or hot briquettes can be added into the carrier about the container to prolong the coldness or hotness of the liquid. Wheels and/or handles are provided on the outside of the carrier to facilitate lifting and transporting the container and its contents.

THE PREFERRED EMBODIMENTS

Figure 1:
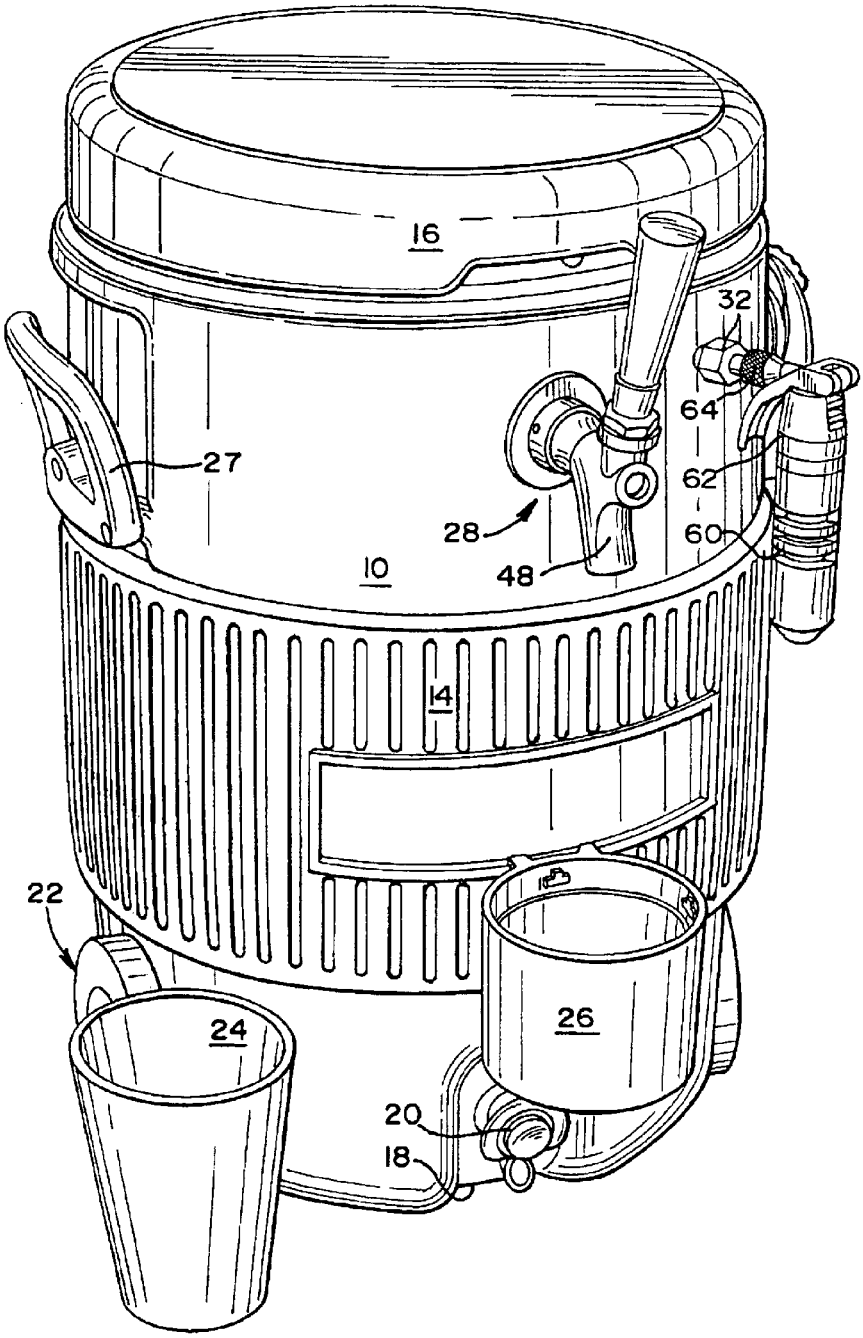
FIG. 1 is a perspective view of the overall configuration and arrangement of the carrier of the present invention, with dispenser, pressurizing device, peripheral and top walls, and handles.

In one form of the invention, a carrier 10 for an interior liquid container 12 is thermally insulated in a peripheral wall 14, a top wall 16, and a bottom wall 18. The carrier 10 is conveniently provided as a commercially available cooler, as IGLOO® or another brand, or it may be custom-made. The container shown has a hard plastic shell with likely a foamed interior for reduction of heat transfer, but other materials may be used, particularly if hot liquids are to be carried and dispensed, such as metal shell with fiberglass insulation. A drain 20 is provided at the bottom of the carrier 10 for release of water from melted ice and any internal liquid spillage; this drain is preferably only opened to the interior when a cooperating button is manually pressed, to avoid dripping when that would be undesirable. Wheels 22 or the like, such as rollers, are provided in the bottom wall 18 or bottom corners of the carrier 10, particularly in larger sizes as for 3- and 5-gallon containers and related carriers. A drip-catching cup 24 is provided at the front of the carrier 10, with a cup holder 26 positioned under a dispensing valve 28, for helping further to avoid spills. One or more handles 27 is affixed to one of the peripheral and top walls 14, 16 of the carrier 10 for lifting and/or carrying the article for use.

The interior of the carrier 10 is sized sufficient for enclosing the desired container 12, preferably with some space for ice cubes or ice shavings, or for hot briquettes, about the outer wall of container 12 and inwardly of the peripheral wall 14 and top wall 16 of the carrier 10. Containers 12 are commercially available in various sizes for containing potable liquids under pressure sufficient for dispensing same, principally as beer kegs in 2.5-, 3, and 5-gallon sizes but also possibly in other forms, as 1-, 1.5-, and 2-gallon sizes. The container 12 is removable from the carrier 12 through the top opening that is normally closed by top wall 16, via a handle 30 on the container.

Figure 2:
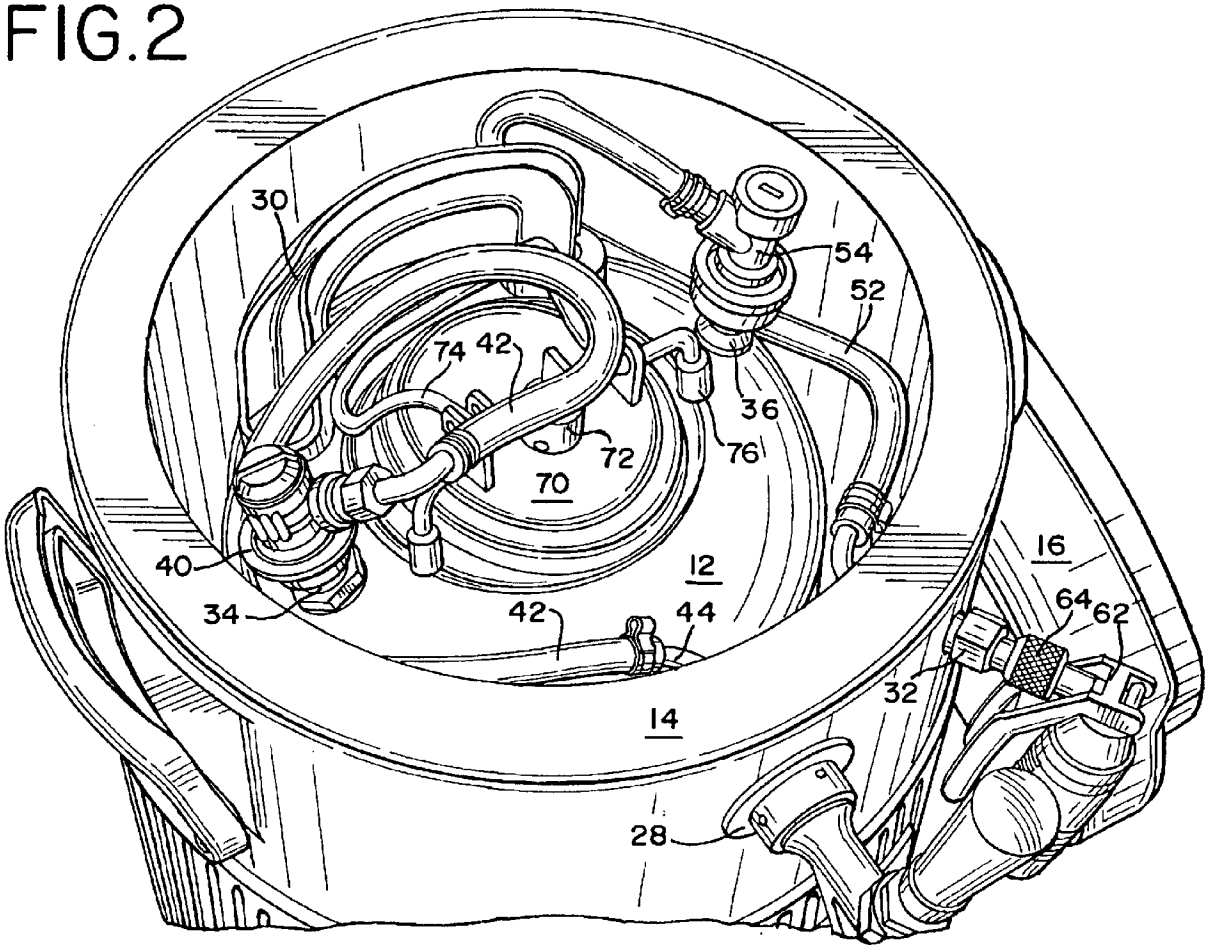
FIG. 2 is a perspective view of the open top of the carrier of the invention, showing the inner container, tubes to pressurize and to dispense the liquid, and refilling cap on the container, as well as space within the carrier for ice or briquettes.

Fitted through the peripheral wall 14 of the carrier 10 are the dispensing valve 28 and a pressurizing inlet 32, as in FIG. 2. Both are permanently fixed in the wall 14 by suitable adhesives, sealants, and mechanical fasteners.

The container 12 has on its upper surface, in this embodiment as in FIG. 2, a dispensing tap 34 and a fixed pressurizing fitting 36. Both the tap 34 and the fitting 36 are sealed in leak-proof relation to an upper part of the peripheral wall 14 of the carrier 10. The tap 34 communicates to an internal pipe (not shown) within the container 12 which goes to the very bottom of the interior of the container, typically radially opposite the center of the handle 30, so that most all of the contents can be dispensed proper tilting of the carrier 10 and container 12 from the vertical using the handle 30, as is well known.

Figure 3:
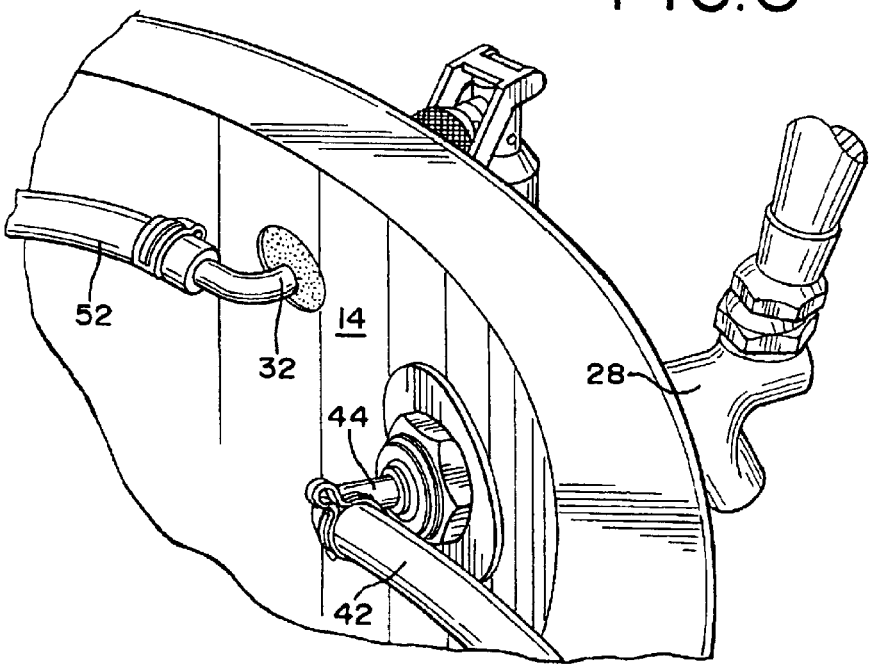
FIG. 3 is a perspective view of the pressure and dispensing taps in the wall of the carrier.

The dispensing tap 34 on the container 12 is connected to the dispensing valve 28 on the carrier 10 by a cooperating fitting 40 carried on a tube 42 which communicates to an upstream side 44 of the dispensing valve 28 (see FIG. 3). The fitting 40 is preferably and conveniently spring-loaded to engage the tap 34 in a quick and positive manner, with lands on the tap 34 (best shown in FIG. 4) inter-fitting with retractable projections (not shown) on the inside recess of fitting 40. A spring-loaded stopper 46 provided in the tap 34 is opened to the interior of container 12 only when the fitting 40 is properly seated on the tap 34, and not before. The valve 28 is a conventional beverage-dispensing spigot, with the inlet side 44 selectively openable to the outlet side 48 by a movable handle 50.

Pressurizing of the interior of the container 12 is accomplished in the preferred embodiment through the fixed pressurizing fitting 32 fitted in the wall 14 of the carrier 10. A one-way stopper valve (not shown) is provided in the fixed fitting 32, so that pressure can only be added to the container 12, not lost from it, through that fitting when all the connections are in place. The inside of the fitting 32 is communicated to the pressure inlet 36 on the container 12 by a tube 52 extending to a movable fitting 54 engageable with that container inlet 36. The pressure inlet 36 is provided with lands similar to those on tap 34, for positive interconnection with the fitting 54. A spring-loaded stopper 56 provided in the fitting 36 is opened to the interior of container 12 only when the movable pressure fitting 54 is properly seated on the container fitting 36, and not before, so that pressure will remain in the container 12 even if the fitting 54 is disconnected.

Gas pressure is applied to the container 12 through the fixed and moveable fittings 32, 54 and the container fitting 36 from a gas cartridge 60 provided in an applicator 62 operated by a trigger assembly as shown in FIG. 1. The applicator 62 is screwed to the fixed fitting 32 by a threaded nut 64 for a leak proof seal. The gas cartridge is punctured in the applicator 62 and gas, such as nitrogen or carbon dioxide, is released to fitting 32 when the trigger is pulled. Generally no pressure regulator is required as the pressure in the cartridge is insufficient to rupture the tubing 52 or 42 or any of the fittings or the container 12, but gentle use of the trigger is recommended lest the liquid be explosively dispensed from the tap outlet 48. Up to about 8 pounds per square inch over atmospheric pressure ("psig") of 14.7 psi is believed usually appropriate for dispensing carbonated beverages such as beer from a 15-inch diameter container and producing an appropriate "head" on the beer in a glass or cup. Alternatively, hand or foot pumps can be connected to the fixed fitting 32, or an electric pump could be used with a regulator to keep any desired level of pressure within the container 12 for dispensing the liquid therein as the container is emptied.

Figure 4:
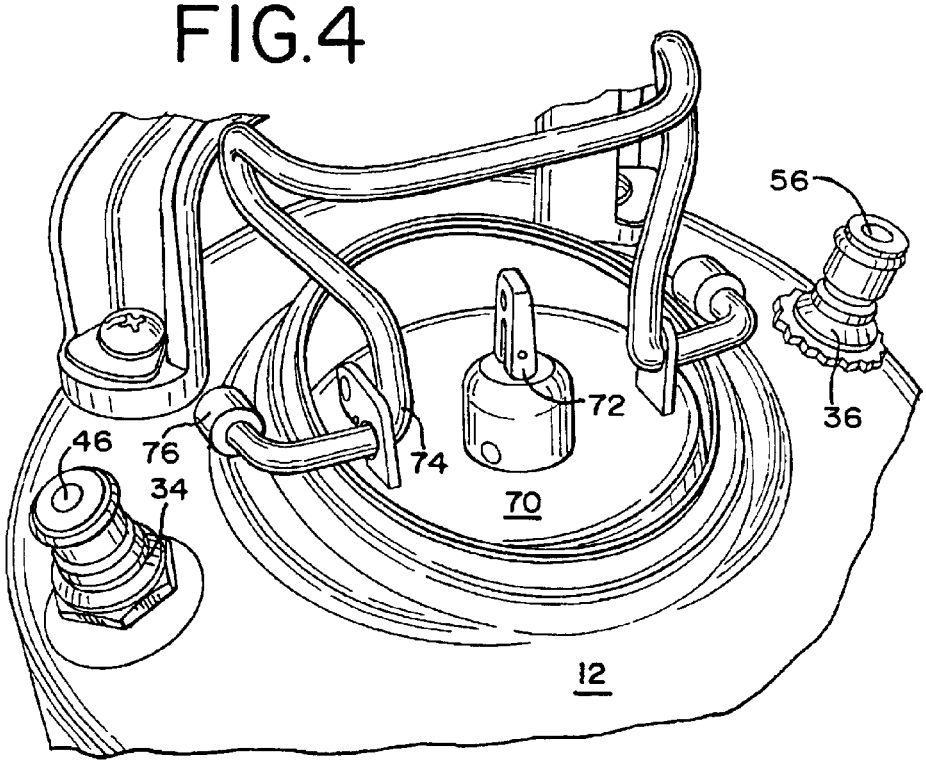
FIG. 4 is a perspective view of the unsealed top of the container for the liquid with the adjacent pressurizing and outlet taps.

For filling or cleaning the container 12, a sealable cover 70 is preferably provided in the top of the container 12, as in FIG. 4. A relief valve 72 is activated if pressure remains in the container when opening is desired, to bypass the stoppers 46, 56 at the fittings 34, 36. Then a strong metal bale 74 is lifted from the position of FIG. 2 to that of FIG. 4, and the shape of the bale disengages feet 76, 76 thereon from the surface of the container 12 so that the cover 70 can pass downwardly into the interior of the container 12, as in FIG. 4. Because the cover 70 is oval, it can be tilted and removed from the container 12 to provide full access to the interior of the container 12 for cleaning and then refilling.

Preferred but not required component parts of the invention have been as follows. The carrier 10 is typically an Igloo or Coleman brand water cooler, as in a 5, 6, or 10-gallon size. Banner Equipment provides a suitable draft beer faucet and shank 28; other makers also supply these. The hose 42 to the keg tap is Banner part no. 590, and the liquid disconnect fitting 40 is Banner part no. 40202 or 40252. The container 12 is a Williams Brewing part no. D05 for the 3-gallon keg, D64 for the 2.5-gallon keg, and D06 for a 5 gallon keg. For the pressure supply, using carbon dioxide gas cartridges, a suitable injector 62 is from Genuine Innovations in Arizona. The standard ¼-inch flare fitting 32 takes the gas through the carrier wall 14 through a one-way valve or air cock, Banner part no. B908-44 (not shown), to a 90-degree swivel hose barb. The barb connects to hose 52 that may be Banner part no. 2105, of braided polyethylene. Banner quick gas disconnect 54, part no. 40201 or 40251, connects the hose 52 to the pressure inlet port 36 on the container 12. One standard carbon dioxide cartridge is good for a pressurizing for dispending about one gallon of liquid, so multiple cartridges should be obtained and used for all sizes of containers for use with the invention.

In use, the container 12 is cleaned and then filled with a desired liquid, preferably at a desired temperature, through the opening left by removal of the cover 70. The cover is then fitted back into the container 12 and the bale 74 is then pressed down to seal the top of the container 12, and the container is chilled or heated until the time for use is near. The container 12 is then placed into the carrier 10 through the open top wall 16, and the fittings 40 and 54 are connected to the taps 34 and 36, respectively, on the container 12. Ice can be added to the space around and above the container 12 within the carrier 10 if desired, to prolong the coldness of the liquid, or hot briquettes can be added if the liquid is hot and the carrier 10 is adapted for hot materials, to prolong a higher serving temperature in that instance. The top wall 16 is put into place and then the carrier 10 with its contents is moved to the place of use. The container 12 may be pre-pressurized, or pressurized on site at the time of use, by placing a gas cartridge 60 into the applicator 62 and fixing the applicator to the fixed fitting 32 via nut 64, and then actuating the trigger on the applicator 62 to a desired extent to cause liquid to come out the spigot 48 under some pressure when the handle 50 is cocked to open the valve 28. Pressure can be added as needed by users who find the rate of dispensing to be too slow or the amount of head on a beer to be inadequate.

Many variations may be made in the invention as shown and its manner of use, without departing from the principles of the invention as described herein and/or as claimed as the invention. Minor variations will not avoid the use of the invention.

I claim as my invention:

1. An article comprising a container for a selected liquid, the container being pressurized and thermally insulated for carrying and dispensing the liquid conveniently, the article comprising:

a thermally insulated carrier with peripheral side and top and bottom walls, at least one of the walls being at least partly openable to an interior of said carrier;

a sealable container sized to be receivable within the carrier and to be insertable into and removable from the carrier through the openable wall, the container being adapted to contain a liquid and a pressure on the liquid of up to at least about 8 psig, and the container having a dispensing tap communicating into the container and to a gravitationally lower portion thereof for passing liquid from the container and a pressurizing inlet communicating into a top portion of the container;

a dispensing valve mounted on and having a passage extending through the peripheral wall of the carrier from a first flexible tube to a liquid outlet, the tube communicating from the dispensing outlet of the container to the valve and the valve passage communicating to the outside of the carrier upon opening the valve;

pressurizing means mounted on and having a second passage extending through the peripheral wall of the carrier to a second flexible tube, the tube extending within the carrier to the pressurizing inlet of the container, the pressurizing means comprising one of a hand-operated air pump, a foot-operated air pump, an electric air pump, and a gas cartridge with suitable gas release mechanism; and at least one handle affixed to one of the carrier peripheral and top walls for manually lifting the article or for manually carrying the article from place to place.

2. The article of claim 1, wherein the carrier is adapted to contain a liquid comprising a potable beverage for human consumption, such as any of beer, water, lemonade, tea, a sports drink, and the like.

3. The article of claim 1, wherein the pressurizing means comprises a gas cartridge that is mounted in a device selectively connected to the pressurizing inlet means.

4. The article of claim 1, wherein the container is cleanable and refillable by one of a consumer of the liquid and a supplier of the liquid.

5. The article of claim 1, wherein the carrier includes at least two ground-engaging wheels or rollers mounted on one of the peripheral and bottom walls and adapted to facilitate rolling the carrier over ground and pavement without continuous lifting by a user.

* * * * *